US009453267B2

(12) United States Patent
Pedersen

(10) Patent No.: US 9,453,267 B2
(45) Date of Patent: Sep. 27, 2016

(54) MACHINE AND METHOD FOR STRETCHING A PELT BEFORE FASTENING TO A PELT BOARD

(75) Inventor: Kurt Pedersen, Vinderup (DK)

(73) Assignee: EIKON TECHNOLOGIES HOLDING SARL, Luxembourg (LU)

( * ) Notice: Subject to any disclaimer, the term of this patent is extended or adjusted under 35 U.S.C. 154(b) by 303 days.

(21) Appl. No.: 14/006,157

(22) PCT Filed: Mar. 8, 2012

(86) PCT No.: PCT/DK2012/000018

§ 371 (c)(1),
(2), (4) Date: Sep. 19, 2013

(87) PCT Pub. No.: WO2012/126467

PCT Pub. Date: Sep. 27, 2012

(65) Prior Publication Data

US 2014/0007627 A1 Jan. 9, 2014

(30) Foreign Application Priority Data

Mar. 22, 2011 (DK) ..... 2011 00204

(51) Int. Cl.
*C14B 15/06* (2006.01)

(52) U.S. Cl.
CPC ..... *C14B 15/06* (2013.01)

(58) Field of Classification Search
CPC ..... C14B 1/26; C14B 1/28; C14B 15/06
USPC ..... 69/19.1
See application file for complete search history.

(56) References Cited

U.S. PATENT DOCUMENTS

| | | | | |
|---|---|---|---|---|
| 4,360,887 | A * | 11/1982 | Wilson | G01N 21/89 348/142 |
| 4,381,654 | A | 5/1983 | Baldridge | |
| 4,945,736 | A * | 8/1990 | Lagori | C14B 15/06 69/19.2 |
| 6,915,669 | B2 * | 7/2005 | Hedegaard | C14B 15/06 69/19.3 |
| 2004/0060330 | A1 * | 4/2004 | Hedegaard | C14B 15/06 69/21 |
| 2010/0058818 | A1 * | 3/2010 | Houtz | C14B 1/28 69/33 |

FOREIGN PATENT DOCUMENTS

| | | | |
|---|---|---|---|
| DK | 96890 | A | 10/1991 |
| DK | 169525 | B1 | 10/1991 |
| DK | 200001836 | L | 6/2002 |
| WO | 0244428 | A1 | 6/2002 |
| WO | 2005028682 | A1 | 3/2005 |
| WO | 2005080607 | A1 | 9/2005 |

OTHER PUBLICATIONS

International Search Report for corresponding application PCT/DK2012/000018 filed Mar. 8, 2012; Mail date Jun. 25, 2012.

* cited by examiner

*Primary Examiner* — Shaun R Hurley
(74) *Attorney, Agent, or Firm* — Cantor Colburn LLP

(57) ABSTRACT

The present invention relates to a method and an apparatus for stretching a pelt on a pelt board, by determining a length of the pelt and adjusting the stretch force in accordance with the determined length. In particular, the length may be determined prior to stretching of the pelt, or the length may be determined after the primary stretching of the pelt stretching the pelt, where after the stretching force is reduced before securing the pelt to the pelt board.

16 Claims, 2 Drawing Sheets

3
L1
1
4
5
5
2
10
6
7
8
9

3
L2
1
4
5
5
2
10
6
7
8
9
Fs,1

3
L2 - dL
1
4
5
5
2
10
6
7
8
9
Fs,1-dF

MACHINE AND METHOD FOR STRETCHING A PELT BEFORE FASTENING TO A PELT BOARD

TECHNICAL FIELD

The present invention relates to a machine for stretching a pelt prior to fastening it to a pelt board for drying.

BACKGROUND

In preparing pelts from e.g. mink or fox, the pelts are after skinning of the animal and a cleaning of the leather side of the pelt stretched out on a pelt board with the leather side facing the board for drying of the pelt. Formerly, the pelts were fixated by means of staplers penetrating the pelt and anchoring into the pelt board, more recently the pelts are secured by means of a sleeve or by means of winding material applied to the fur side of the pelt.

The price of a pelt is established from a number of features, including the final length of the dried pelt from the nose to the beginning of the tail. The pelts are classified in sizes according to the length in classes, which at least for mink have 6 centimeters interval. Thus, by stretching a pelt sufficiently to reach a higher size before it is fastened to the pelt board, the value of the pelt may be increased, however with the risk of reducing the value due to overstretching or damages to the pelt.

Danish patent No. DK 169 525 discloses a machine for stretching of pelts on pelt boards, where a first stretch force is applied to stretch the pelt and, in case it is detected that the pelt length is close to the next higher classification size, a second, higher stretch force is applied to the pelt.

International patent application No. WO 02/44428 discloses a further development of this machine by adding a vibrating movement to the pelt during the stretching thereof, whereby an increased stretching of the pelt is achieved without causing damages to the pelt.

In the international patent application No. WO 2005/028682 a device for stretching of pelts is disclosed, where holding elements are provided to grip, engage and fasten the pelt along the whole periphery of the lower end of the pelt, thereby applying the stretch force more uniformly to the pelt and allowing for an increased stretching thereof. The pelt is secured in the stretched position by means of a sleeve drawn over the fur side of the pelt from a tip of the pelt board, i.e. from the nose end of the pelt.

In the international patent application No. WO 2005/080607 the pelt is secured to the pelt board after stretching of the pelt by means of a winding material, such as a band, which is wound around the lower end part of the pelt, i.e. near the tail part.

BRIEF SUMMARY

The invention provides an improved method for stretching pelts on pelt boards before drying where an improved quality of the pelt is achieved resulting in a higher price being paid for the pelt and preventing damages to the pelt caused by the stretching.

This is reached with a method for stretching a pelt comprising the steps of arranging the pelt on a pelt board, determining a measure of the length of the pelt, stretching the pelt with a stretch force determined from said determined length of the pelt, and securing the pelt to the pelt board.

The pelt board may be any type of pelt board were the pelt having a tube-like shape can be slipped over so that the nose end of the pelt, i.e. the end that formerly covered the cranium of the animal, will rest at a tip end of the pelt board. The known pelt boards are normally of a tapered shape with the tip end having the smallest circumference. Wooden pelt boards with a flat cross section have been widely in use and are suitable for fastening staples into, whereas more modern pelt boards are made of plastics material and are of an elliptic or oval cross-section with internal openings for improving the drying of the pelt arranged thereon.

The measure of the length of the pelt may be an actual length of the pelt as measured from the nose of the pelt to the beginning of the tail, or it may be an indirect measure, such as the position of the lower end of the pelt board or of the tip end of the pelt board relatively to another part of the apparatus carrying out the method, in particular relatively to pelt holders for gripping at least parts of the tail end of the pelt. The measure of the length of the pelt is preferably established when the pelt is arranged on the pelt board but could also in accordance with the present invention be determined prior to the pelt being arranged on the pelt board, e.g. by a vision system.

It has by the present inventor been determined that the optimal force that can be applied to a pelt, i.e. the stretch force that will cause the maximum stretching of the pelt without causing damages to the pelt, can be determined at least partially from the length of the pelt prior to the stretching thereof. Other factors are e.g. the sex of the animal, for which the apparatus for stretching the pelt normally will be adjusted.

The stretch force is preferably determined from a predefined monotonic relation between the determined length of the pelt prior to stretching thereof and the stretch force, i.e. so that a longer pelt will be exposed to a higher stretch force. In particular, the stretch force may be determined from a continuous relation, such as a linear relation between the determined length of the pelt prior to stretching thereof and the stretch force. Alternative relations in accordance with the present invention include stepwise relations and polynomial relations.

In order to ensure a uniform and consistent determination of a measure of the length of the pelts, the method preferably comprises the step of gripping at least a part of the lower periphery of the pelt by pelt holders prior to determining the length of the pelt prior to stretching thereof.

Furthermore, the method may comprise the steps of determining a measure of a stretched length of the pelt when said determined stretch force is applied to the pelt, and selectively reducing the stretch force based on said determined stretched length before securing the pelt to the pelt board. This is done in order to limit the stretching of the pelt to the degree necessary to reach the highest classification size possible.

The measure of the stretched length of the pelt may be detected as discussed previously with respect to the unstretched length of the pelt, i.e. by detecting the longitudinal position of the pelt board with respect to e.g. the pelt holders or by means of a vision system. Alternatively, the detection system as disclosed in Danish patent No. DK 169 525 as discussed previously may be employed.

The advantage of reducing the stretch force in those cases where a substantial reduction in the stretched length of the pelt may be obtained without the pelt when dried will be classified in a lower classification size is that the reduced stretching will automatically cause the density of the fur as measured in number of hair per skin area unit will increase, which again may lead to a higher classification of the fur quality of the pelt with higher value of the pelt.

The stretch force may preferably be reduced until the length of the pelt is a predetermined distance longer than one of a plurality of predetermined classification size lengths so as to allow for some shrinkage of the pelt during drying thereof and after removal from the pelt board without changing the classification size of the pelt.

At least some of said predetermined classification size lengths have mutual intervals of 6 centimeters as is currently the case for at least mink pelts.

Said predetermined distance may be in the range of 3 to 15 millimeters, preferably in the range of 8 to 12 millimeters.

The present invention furthermore relates to an apparatus for stretching a pelt on a pelt board in accordance with the method described above, the apparatus comprising a pelt board holder for holding one end of the pelt board, pelt holders arranged to grip at least a part of the lower periphery of the pelt when arranged on the pelt board, driver for mutually displacing the pelt board placed in the pelt board holder and the pelt holders in a longitudinal direction of the pelt board, controller for controlling the operation of the driver, and length measuring device for determining a measure of the length of a pelt on the pelt board placed in the pelt board holder and providing an output accordingly to the controller, wherein the controller is arranged to determine a stretch force based on said output from the length measuring device and control the driver to apply the determined stretch force to the pelt.

The apparatus may be arranged and equipped for being able to carry out the method according to the various preferred embodiments discussed above.

The step of reducing the stretch force may be applied to any stretch force and is thus not limited to the method of determining a stretch force as discussed previously but may be regarded as an independent invention. Thus, the present invention also relates to a method for stretching a pelt comprising the steps of arranging the pelt on a pelt board, stretching the pelt with a stretch force, determining a measure of a stretched length of the pelt when said stretch force is applied to the pelt, and selectively reducing the stretch force based on said determined stretched length before securing the pelt to the pelt board.

This method may furthermore comprise any of the preferred relevant embodiments related to the reduction of the stretch force as discussed above. Also, the present invention relates to an apparatus suitable for carrying out this method, an apparatus for stretching a pelt on a pelt board comprising a pelt board holder for holding one end of the pelt board, pelt holders arranged to grip at least a part of the lower periphery of the pelt when arranged on the pelt board, driver for mutually displacing the pelt board placed in the pelt board holder and the pelt holders in a longitudinal direction of the pelt board, controller for controlling the operation of the driver to apply a stretch force to the pelt, length measuring device for determining a measure of the stretched length of the pelt when said stretch force is applied to the pelt and provide an output accordingly to the controller, wherein the controller is arranged to selectively reduce the stretch force based on said second output from the length measuring device by controlling the driver.

This apparatus may be arranged and equipped for being able to carry out the method according to the various preferred embodiments discussed above.

BRIEF DESCRIPTION OF THE DRAWING

A preferred embodiment of the present invention is illustrated with the enclosed drawing, of which

DETAILED DESCRIPTION OF AN EMBODIMENT OF THE INVENTION

Figure 1:
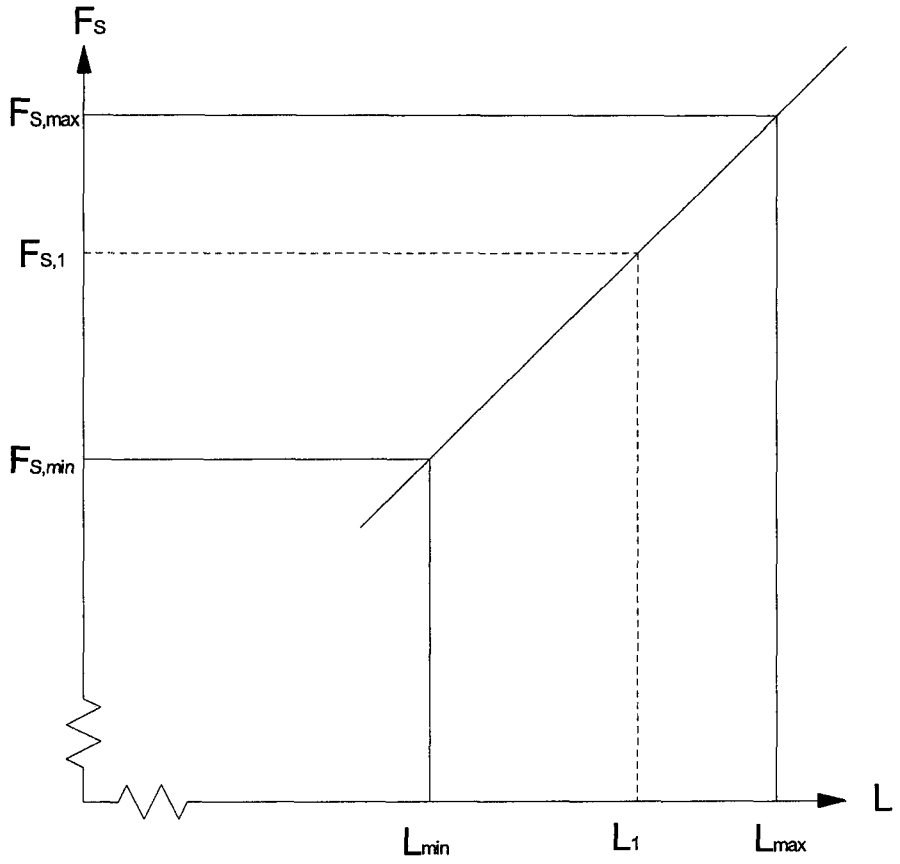
FIG. 1 is a diagram showing the relation between the length of the pelt prior to stretching of the pelt and the stretch force.

The method according to the present invention involves the measurement of a length $L_1$ of the pelt 1 that is to be fastened to the pelt board 2 prior to drying of the pelt. The length $L_1$ of the pelt 1 is defined to be from the nose at the nose end 3 of the pelt to the beginning of the tail at the tail end 4 of the pelt 1. In FIG. 1 is shown a diagram of the function according to which the controller of the apparatus for stretching the pelt 1 and securing it to the pelt board 2 determines the stretch force $F_S$ to be applied to the pelt 1.

The operator of the apparatus has prior to the operation defined a minimum stretch force $F_{S,min}$ to be applied to a pelt 1 having a defined minimum length $L_{min}$ and a maximum stretch force $F_{S,max}$ to be applied to a pelt 1 having a maximum length $L_{max}$. According to the function shown in FIG. 1, a simple linear interpolation between these two extreme sets of values is performed for determining the stretch force $F_{S,1}$ to be applied to a given pelt 1 of a length $L_1$ that has been determined when the pelt 1 is arranged on the pelt board 2 in the apparatus.

Figures 2, 3, 4:
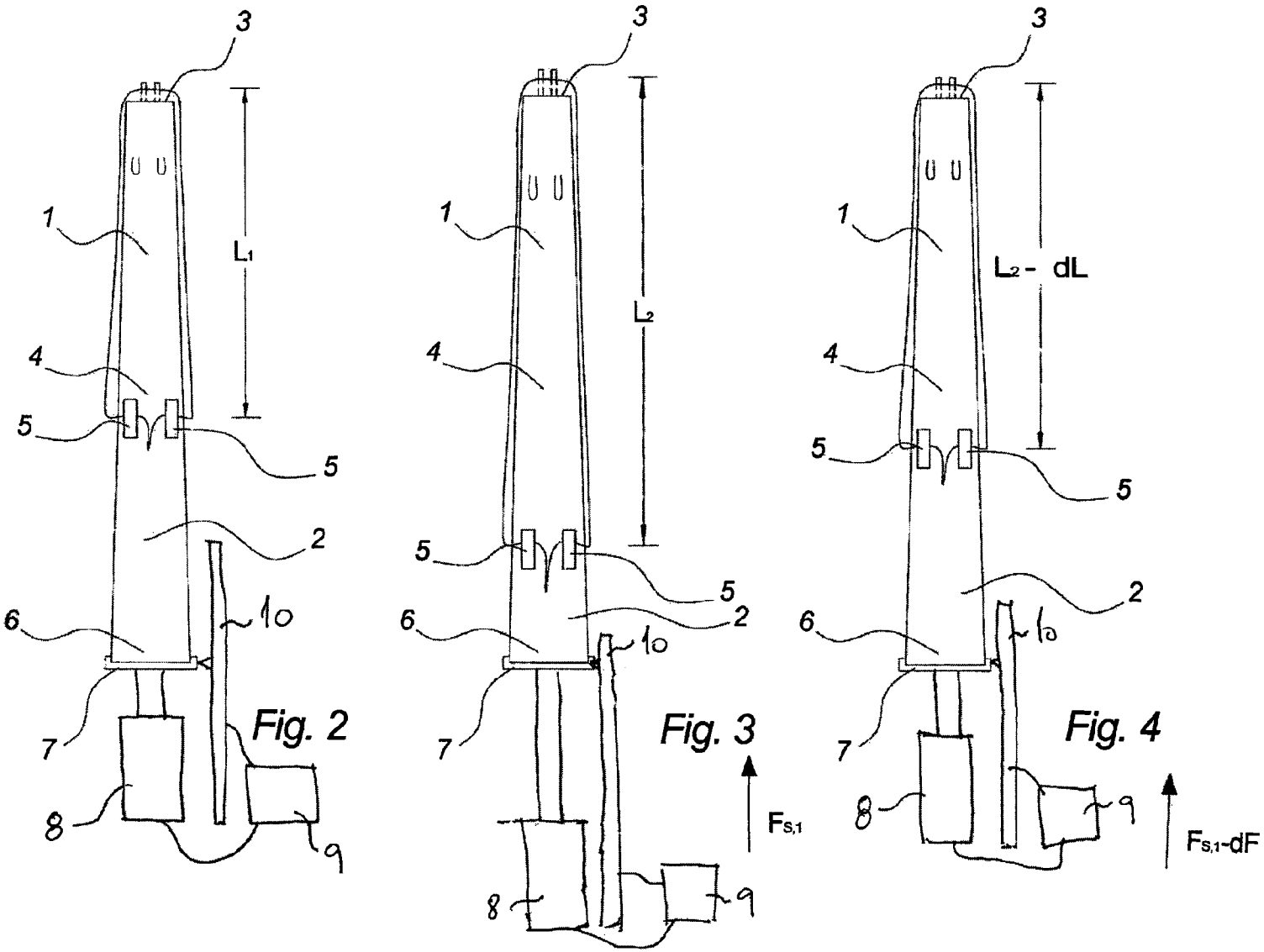
FIG. 2 shows the pelt arranged on the pelt board and gripped by the pelt holders at the lower periphery of the pelt prior to stretching of the pelt.
FIG. 3 shows the pelt on the pelt board when the determined stretching force is applied to the pelt.
FIG. 4 shows the pelt on the pelt board when the stretch force has been reduced until the length of the pelt is a predetermined distance longer than one of a plurality of predetermined classification size lengths.

FIG. 2 shows the pelt 1 arranged on the pelt board 2. Parts of the lower periphery of the pelt 1 are gripped by the pelt holders 5 and the length $L_1$ of the pelt prior to stretching of the pelt 1 is determined. The lower, thick end 6 of the pelt board 2 is placed in the pelt board holder 7 of the apparatus, and pelt board holder 7 is moved upwards without applying a stretching force to the pelt 1 until the pelt 1 is tight, where after a measure of the length $L_1$ of the pelt 1 is determined from the position of the pelt board holder 7 and the type of pelt board 2 detected by the pelt board holder 7. A driver 8 is arranged to displace the pelt board holder 7 and a controller 9 receives a measure of the length L of the pelt from a length measuring device 10 determining the position of the pelt board holder 7 and controls the driver 8 correspondingly. The type of pelt board 2 is selected from the size of the pelt 1 which is determined largely by the sex of the animal from which the pelt origins. Male pelts 1 are longer and wider for which reason the pelt boards 2 for the male pelts 1 are longer and has a larger cross-sectional circumference than pelt boards 2 for female pelts 1. Alternatively, the pelt board 2 type is entered by the operator into the controller of the apparatus as the apparatus in many cases has to be adjusted generally for the type of pelt boards 2, e.g. by selecting pelt holders 5 suitable for male pelts or for female pelts. The length limits $L_{min}$, $L_{max}$ as well as the stretch force limits $F_{S,min}$, $F_{S,max}$ may also be adjusted selectively for male pelts and for female pelts, respectively.

When the determined stretch force $F_{S,1}$ is being applied to the pelt by moving the pelt board holder 7 upwards relatively to the pelt holders 5 as shown in FIG. 3, where the result is that the pelt 1 is stretched to a new, stretched length of $L_2$.

The stretched length $L_2$ of the pelt 1 is determined in the same manner from the position of the pelt board holder 7 and the controller of the apparatus compares the determined stretched length $L_2$ with the classification size lengths for the particular type of pelt 1. In case the pelt 1 is a mink pelt, the classification size length of the pelts 1 have mutual intervals of 6 centimeters and in case the overshoot with respect to the nearest, lower classification size length is sufficient, e.g. more than 2 centimeters, the reduction step is initiated.

The reduction step comprises in one embodiment a gradually reduction of the stretch force $F_S$ applied to the pelt and a consecutive repeated measurement of the stretched length $L_S$ until the stretched length $L_S$ is a predetermined distance $L_d$ longer than the nearest, lower classification size length. The determined stretch force $F_{S,1}$ is then as shown in FIG. 4 reduced by an amount dF so that the stretched length $L_2$ when the determined stretch force $F_{S,1}$ is applied to the pelt 1 will be reduced by a length dL whereby the final stretched length $L_S$ is reached.

The length of the predetermined distance $L_d$ is set to ensure that the pelt after drying and removal from the pelt board 2 will still be of the intended length classification size. The distance $L_d$ is thus intended to compensate for further shrinkage of the pelt after it has been removed from the pelt board as well as possible shrinkage when it is arranged on the pelt board and secured thereto, where some of the securing methods, such as wrapping as well as the use of a sleeve on the fur side of the pelt inherently has a higher risk of some shrinkage of the pelt when secured to the pelt board. For the use of wrapping as securing method, a predetermined distance $L_d$ of 10 millimeters has proven to be advantageous.

In an alternative embodiment, the reduction step comprises a stepwise reduction of the stretch force $F_S$ and a subsequent determination of the stretched length $L_S$ of the pelt until the required length is reached.

In a further alternative, the reduction step comprises a one-step reduction of the stretch force $F_S$ by a predetermined amount dF which is known to cause an acceptable reduction dL in stretched length $L_S$ from the initial stretched length of the pelt.

The reduction step may be performed on any type of apparatus for stretching a pelt on a pelt board and is not confined to be used with the determination of the stretch force based on the length of the pelt as disclosed herein.

The invention claimed is:

1. Method for stretching a pelt by means of a pelt stretching apparatus, comprising the steps of arranging the pelt on a pelt board, determining a measure of the length of the pelt prior to stretching thereof, providing said determined length of the pelt to a controller of the pelt stretching apparatus, determining, by means of the controller, a stretch force for the pelt based on said determined length of the pelt, gripping at least a part of the lower periphery of the pelt by pelt holders of the apparatus, controlling a driver of the apparatus by means of the controller to apply the determined stretch force to the pelt, the stretch force being determined from said determined length of the pelt by mutually displacing the pelt board and the pelt holders in a longitudinal direction of the pelt board, and securing the pelt to the pelt board.

2. Method according to claim 1, wherein the stretch force is determined from a predefined monotonic relation between the determined length of the pelt prior to stretching thereof and the stretch force.

3. Method according to claim 2, wherein the stretch force is determined from a linear relation between the determined length of the pelt prior to stretching thereof and the stretch force.

4. Method according to claim 1, comprising the step of gripping at least a part of the lower periphery of the pelt by pelt holders prior to determining the length of the pelt prior to stretching thereof.

5. Method according to claim 1, further comprising the steps of determining a measure of a stretched length of the pelt when said stretch force is applied to the pelt, and selectively reducing the stretch force based on said determined stretched length before securing the pelt to the pelt board, so the stretched length of the pelt is reduced.

6. Method according to claim 5, wherein the stretch force is reduced until the length of the pelt is a predetermined distance longer than one of a plurality of predetermined classification size lengths.

7. Method according to claim 6, wherein said predetermined classification size lengths have mutual intervals of 6 centimeters.

8. Method according to claim 6, wherein said predetermined distance is in the range of 3 to 15 millimeters.

9. Apparatus for stretching a pelt on a pelt board comprising a pelt board holder for holding one end of the pelt board, pelt holders arranged to grip at least a part of the lower periphery of the pelt when arranged on the pelt board, driver for mutually displacing the pelt board placed in the pelt board holder and the pelt holders in a longitudinal direction of the pelt board, controller for controlling the operation of the driver, and length measuring device for determining a measure of the length of a pelt on the pelt board placed in the pelt board holder prior to stretching thereof and providing an output accordingly to the controller, wherein the controller is arranged to determine a stretch force based on said output from the length measuring device and control the driver to apply the determined stretch force to the pelt.

10. Apparatus according to claim 9, wherein the controller is arranged to determine the stretch force from a predefined monotonic relation between the determined length of the pelt prior to stretching thereof and the stretch force.

11. Apparatus according to claim 10, wherein the monotonic relation is a linear relation between the determined length of the pelt prior to stretching thereof and the stretch force.

12. Apparatus according to claim 9, wherein the length measuring device is arranged to determine a measure of the length of the pelt when at least a part of the lower periphery (4) of the pelt is gripped by the pelt holders.

13. Apparatus according to claim 9, wherein the length measuring device furthermore is arranged to determine a measure of the stretched length of the pelt when said stretch force is applied to the pelt and provide a second output accordingly to the controller, and the controller is arranged to selectively reduce the stretch force based on said second output from the length measuring device by controlling the driver so as to reduce the stretched length of the pelt.

14. Apparatus according to claim 13, wherein the controller is arranged to reduce the stretch force until the length of the pelt is a predetermined distance longer than one of a plurality of predetermined classification size lengths.

15. Apparatus according to claim 14, wherein at least some of said predetermined classification size lengths have mutual intervals of 6 centimeters.

16. Apparatus according to claim 15, wherein said predetermined distance is in the range of 3 to 15 millimeters.

* * * * *